United States Patent [19]

Hall

[11] Patent Number: 4,698,033

[45] Date of Patent: Oct. 6, 1987

[54] RECREATIONAL WATERCRAFT

[76] Inventor: Shirl F. Hall, 3585 Jefferson Rd., Ashtabula, Ohio 44004

[21] Appl. No.: 868,758

[22] Filed: May 30, 1986

[51] Int. Cl.[4] ..... A63B 35/04

[52] U.S. Cl. ..... 440/27

[58] Field of Search ..... 114/39.2, 345; 441/65, 441/74, 66, 79; 440/21, 26-31, 90

[56] References Cited

U.S. PATENT DOCUMENTS

| | | | |
|---|---|---|---|
| 1,640,390 | 8/1927 | Bacon | 440/27 |
| 3,180,306 | 4/1965 | Gouedy | 440/26 |
| 3,399,408 | 9/1968 | Bailey et al. | 441/65 |
| 3,779,202 | 12/1973 | Martin et al. | 440/27 |
| 3,874,319 | 4/1975 | Martin et al. | 440/27 |
| 4,437,840 | 3/1984 | Filippos | 440/27 |

FOREIGN PATENT DOCUMENTS

| | | | |
|---|---|---|---|
| 2164255 | 6/1973 | Fed. Rep. of Germany | 440/27 |
| 2252952 | 6/1975 | France | 440/26 |

*Primary Examiner*—Jeffrey V. Nase
*Assistant Examiner*—Stephen P. Avila
*Attorney, Agent, or Firm*—D. Peter Hochberg

[57] ABSTRACT

A manually propelled personal watecraft has a nose portion (12) of rigid, thin plastic material and a frame assembly (14) extending rearwardly therefrom. An inflatable body portion (16) is fastened to the frame assembly. Stabilizers including keel fins (34, 36) extend downwardly from the craft and function to keep the craft upright and to guide the craft straight in the water. A paddle assembly (38) includes a shaft (39) journalled for rotation in the nose portion. U-shaped portions (40, 42) which serve as manual cranks. Paddles (56, 58) are attached to both ends of the shaft outboard of the U-shaped portions. A rider lies in the prone position and propels the craft by rotating the shaft with his arms.

15 Claims, 2 Drawing Figures

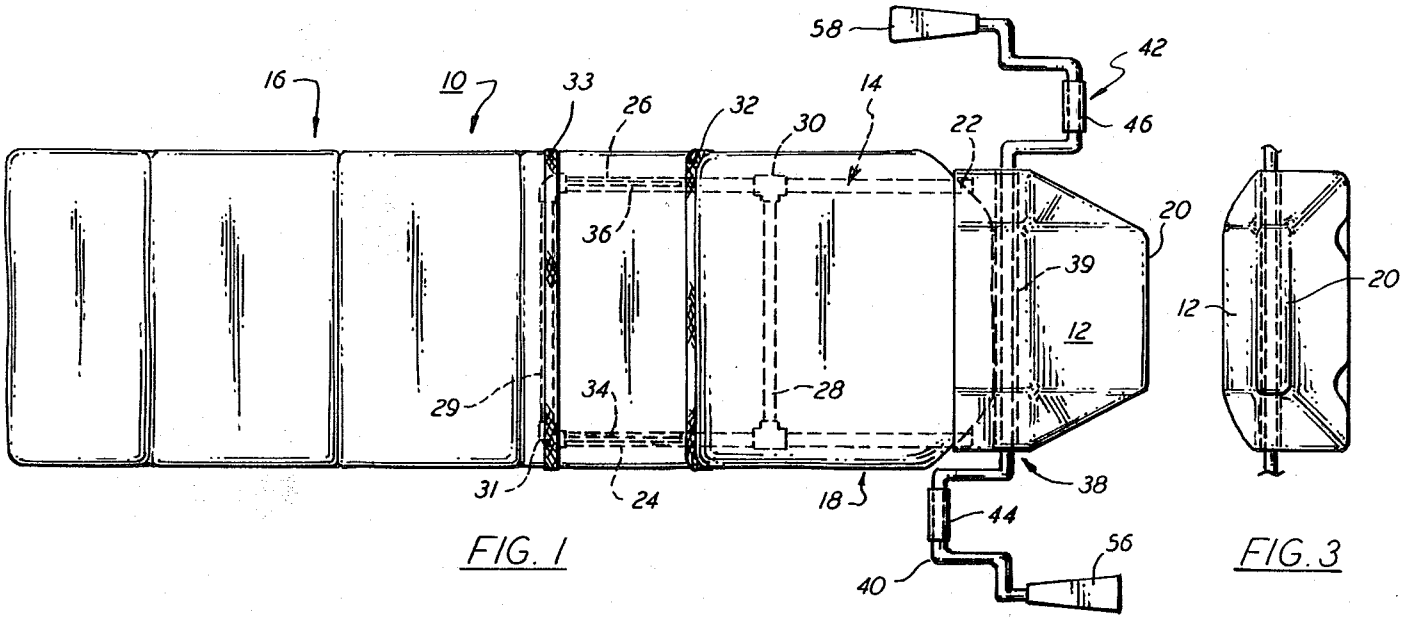
FIG. 1
FIG. 3
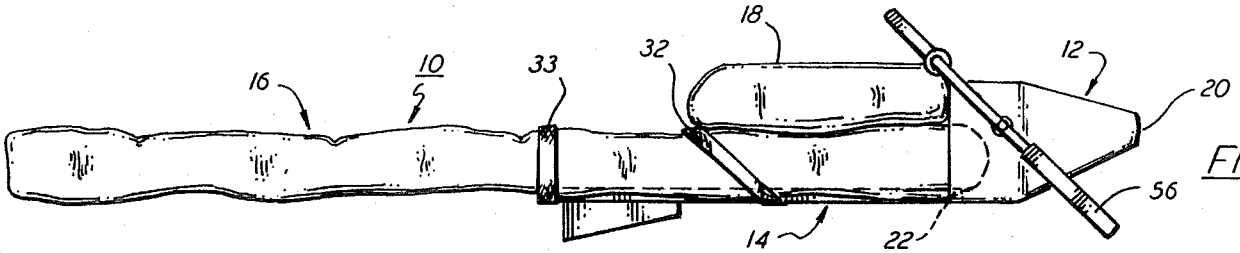
FIG. 2

RECREATIONAL WATERCRAFT

TECHNICAL FIELD

This invention relates to personal watercraft which are manually propelled. The invention also relates to inflatable watercraft, which when not in use can be deflated and disassembled for ease of storage and transport.

BACKGROUND ART

Several types of manually propelled watercraft are known in the prior art. U.S. Pat. Nos. 1,640,390; 3,180,306; 3,779,202; and 3,874,319 all disclose manually propelled watercraft having a solid elongated body and a propulsion system consisting of a pair of manually driven propellers located at the front of such body. The rider lies prone on his stomach and propels the craft by turning a crankshaft with his arms which drives the propellers. All of these prior art devices suffer from the disadvantage that the elongated body of the craft must be at least as long as the typical rider. This makes the craft difficult to store and transport. The "surf board" style bodies of these devices lie low in the water. As a result even small waves wash over the craft and its rider. These devices also offer little in the way of comfort to the rider who lies on the hard upper surface of the craft. It is painful for the rider when the craft is buffeted by waves. Another problem of prior manually propelled watercraft is that the arc of rotation of the crankshafts used to propel the craft, extends below the craft's bottom. Thus, in shallow water the rider may strike his hands on rocks or other obstructions resulting in injury.

Inflatable watercraft have also been known for many years. Inflatable "air mattresses" have the advantage that they are comfortable to ride and easy to store in the deflated condition. Such craft have traditionally had the disadvantage that they are unstable and easily overturned by wave action or by relatively small movements of the rider. Inflatable craft have generally not been adopted for manual propulsion due to the difficulties associated with mounting the propulsion mechanism on the inflatable body. U.S. Pat. No. 4,376,420 discloses a leg driven personal watercraft. This craft is designed with a Y-shaped body which helps to overcome some of the instability associated with its inflatable construction. This craft would still have considerable inherent instability however. This leg driven craft could not be adapted to manual propulsion, because the craft could not support the weight of a rider's torso in the propeller area and the water spray generated by the inboard paddle construction would not be acceptable on the rider's face and upper body.

Thus, there exists a need for a manually propelled personal watercraft which is highly stable and which provides comfort and ease of storage.

SUMMARY OF THE INVENTION

An object of the present invention is to provide an improved, manually propelled recreational watercraft of light weight and simple construction.

It is a further object of the present invention is to provide a manually propelled personal watercraft that provides comfort for the rider.

It is another object of the present invention to provide a manually propelled personal watercraft which has an inflatable body and yet has great stability in the water.

Yet another object of the present invention is to provide a manually propelled personal watercraft having a rigid head portion which prevents waves from washing over the craft and which protects the rider's hands from obstructions in the water.

It is also an object of the present invention to provide a manually propelled personal watercraft which may be disassembled for ease of storage and transport.

It is a further object to provide a manually propelled personal watercraft which is easy to operate and inexpensive to produce.

Further objects of the present invention will become apparent from the attached description and appended claims.

The foregoing objects are accomplished according to the preferred embodiment of the invention by a personal watercraft having a rounded nose portion of rigid material, a frame attached to and extending rearwardly from the nose portion, and an inflatable "air mattress" body portion secured to the frame. An inflatable pillow is located on the body near the nose portion. A paddle assembly includes a shaft journalled for rotation in the nose portion, and includes manually rotable U-shaped portions in the shaft and outboard on both sides of the nose portion which serve as crank means. The shaft terminates outboard of the U-shaped portions in paddles mounted on the shaft such that the paddles rotate with the shaft. A frame composed of a pair of spaced rigid buoyant tubular members extends from the nose portion under the body portion. Stabilizers incorporating keel fins extend downwardly for guiding the craft through the water and keeping it upright. The paddle assembly is mounted to the nose portion to be easily disconnected from the nose portion. When the craft is not in use the body and the pillow can be deflated and removed from the frame.

BRIEF SUMMARY OF DRAWINGS

FIG. 1 is a plan view of the preferred embodiment of the personal watercraft of the present invention in the assembled condition.

FIGS. 2 and 3 are side and front views, respectively, of the personal watercraft shown in FIG. 1.

DETAILED DESCRIPTION OF THE PREFERRED EMBODIMENT

Referring now to the drawings and particularly to FIG. 1 there is shown the preferred embodiment of the personal watercraft of the present invention generally referred to by the reference number 10. The watercraft has a forward nose portion 12 made of formed plastic sheet, a frame assembly 14 extending rearwardly from nose portion 12, an inflatable body portion 16 secured to frame 14, and an inflatable pillow portion 18 mounted on and secured to body portion 16 adjacent nose portion 12. Pillow portion 18 can be secured by means of straps, snaps or the like or can be integral with body portion 16. Nose portion 12 has an open rear section and tapers to a relatively narrow, closed front section 20. Body portion 16 and pillow portion 18 are preferably rectangular air mattresses which are segmented into transverse segments. The front part of body portion 16 extends into the open rear section of hollow nose portion 2. Nose portion 12 can alternatively be made of rigid foam with a rearward cavity for receiving the forward part of body portion 16.

Pillow portion 18 and body portion 16 are secured to frame assembly 14 which is attached at its forward end to sockets or other receptacles 22 in nose portion 12 and extends rearwardly. Frame assembly 14 is composed of a pair of longitudinal side members 24, 26 and a pair of cross members 28, 29. The side members 24, 26, and cross members 28, 29 can be composed of straight plastic tubular members with threaded end sections, which are connected together by appropriately threaded T-couplings 30 and elbows 31 in a known manner. The inflated body portion 16 is attached to frame 14 by means of tie-down straps 32, 33 which have smooth edges to protect the inflated members. In order to stabilize watercraft 10, a pair of keel fins 34, 36 are attached to the rearward parts of side members 24 and 26, respectively, by appropriate straps, rivets or other fastening means.

A paddle assembly 38 is provided for propelling the craft in the water. The paddle assembly comprises a shaft 39 journalled in nose portion 12. Shaft 39 incorporates U-shaped portions 40, 42 which serve as crank means for rotating the shaft. Hand grips 44, 46 rotatable on the respective U-shaped portions provide for ease of turning the shaft with the hands. At each of its ends, shaft 39 is fixedly attached to single-bladed paddles 48, 50, respectively, which serve as paddle means. Paddles 48, 50 include paddle shafts 52, 54, respectively, and main paddle blades 56, 58. In the preferred embodiment the U-shaped portions 40, 42 are spaced at 180 degrees and in opposed fashion. This arrangement provides for more uniform effort by the rider in propelling the craft. Collar means 46 mounted on shaft 39 on both sides of nose portion 12 keep shaft 39 in proper alignment. The respective components of the foregoing paddle assembly are preferably composed of straight, threaded plastic pipe sections connected together by compatible plastic elbows.

Provision may be made for the paddle means and the crank means to be detachable from nose portion 12. This will result in the craft being smaller in the disassembled condition for ease of transport and storage. While in the preferred embodiment the single shaft means drives both paddles together, a split shaft arrangement which would allow each paddle to be driven independently may also be used. While the paddle means is shown outboard of the crank means, the paddle means may be inboard of the crank means or even in a cavity underneath the nose portion.

The rider of the watercraft lies prone on body portion 16 with his head located on or above pillow portion 18.

Pillow portion 18 carries much of the weight of the rider's upper body and torso and serve to keep the top surface of the craft and rider up out of the water. Because of the flexible nature of body portion 16, it flexes with the rider as he moves on the craft and cushions the rider's body from wave action.

The rider propels the craft by turning the crank means using hand grips 44, 46. Propelling the craft simulates the arm action of swimming. The lower part of nose portion 12 extends below the arcuate travel of hand grips 44, 46 which prevents the hands from being struck by submerged rocks and other obstructions in shallow water. Nose portion 12 has a streamlined front section which serves to deflect waves under the craft which helps to keep the rider dry. The rider uses one foot or the other as a rudder to steer the craft. For example, to turn right the rider lowers the right foot into the water and turns the crank means.

Side frame members 24 and 26 assist both in supporting body portion 16 and also in keeping the craft high in the water. The spaced relation of the frame members with fins 34, 36 help prevent the craft from tipping. This is particularly important because in the preferred embodiment the rider shifts his weight to steer the craft.

In the preferred embodiment tubular side members 24, 26 are used to support and stabilize the craft. Other stabilizers and stabilizers of different cross sections may also be used successfully. Though in the preferred embodiment the side frame members 24, 26 are rigidly attached to nose portion 12 in the assembled condition, it will be apparent to those skilled in the art that the stabilizers need not be connected to the nose portion.

Thus the new personal watercraft achieves the above-stated objectives, eliminates difficulties encountered in the use of prior devices and solves problems and obtains the desirable results described herein.

In the foregoing description certain terms have been used for brevity, clarity and understanding; however, no unnecessary limitations are to be implied therefrom because such terms are for descriptive purposes and are intended to be broadly construed. Moreover, the descriptions and illustrates given are by way of example and the invention is not limited to the exact details shown or described.

Having described the features, discoveries, and principles of the invention, the manner in which it is constructed, and the advantages and useful results obtained, the new and useful structures, devices, elements, arrangements, parts, combinations, systems, equipment, operations and relationships are set forth in the appended claims.

I claim:

1. A manually propelled watercraft for supporting a rider in a prone position, said watercraft comprising:

a forwardly disposed rigid nose portion;

frame means attached to said nose portion and extending longitudinally rearwardly from said nose portion, said frame means terminating in a rearward end portion;

an inflatable body portion mounted on said frame means, and extending rearwardly beyond the rearward end portion of said frame means to render said body portion flexible;

fastening means securing said body portion to said frame means;

a paddle assembly mounted in said nose portion, said paddle assembly including:

shaft means rotatably mounted in said nose portion and extending in a traverse direction;

crank means at opposite end sections of said shaft means, said crank means having an arc of rotation, and a nose portion extending forwardly of said crank means and below said arc of rotation; and paddle means attached to said shaft means;

said crank means being graspable by a rider lying prone on the watercraft and rotatable to rotate said shaft means and said paddle means to propel the watercraft in water.

2. The invention according to claim 1 wherein said stabilizer means comprise keel means.

3. The invention according to claim 2 wherein said keel means are mounted on said frame means.

4. The invention according to claim 1 wherein said body portion is an air mattress.

5. The invention according to claim 1 and further comprising a buoyant pillow portion mounted on said body portion in supporting contact with said upper torso of said rider adjacent said nose portion.

6. The invention according to claim 5 wherein said pillow portion is an inflatable pillow.

7. The invention according to claim 1 wherein said frame means include a pair of longitudinally extending tubular side frame members.

8. The invention according to claim 7 wherein said stabilizing means include said side frame members.

9. The invention according to claim 8 wherein said stabilizing means further include a pair of keel members attached to and extending downwardly from said side frame members.

10. The invention according to claim 7 wherein said frame means comprises a plurality of tubular members threaded at their opposite ends and coupling members threaded to cooperate with the threaded ends of said tubular members to couple said tubular members to form said frame.

11. The invention according to claim 1 wherein said paddle assembly comprises a plurality of tubular members threaded at their opposite ends and coupling members threaded to cooperate with the threaded ends of said tubular members to couple said tubular members to form said assembly.

12. The invention according to claim 1 wherein crank means are disposed outboard of said nose portion.

13. The invention according to claim 1 wherein said nose portion is rigid form plastic sheet tapering from a wide open rearward section for receiving a forward portion of said body portion.

14. The invention according to claim 1 wherein said nose portion includes side walls, and opposing receptacles in the respective side walls for receiving for rotation opposite end portions of said shaft means.

15. The invention according to claim 1 wherein said fastening means comprise a strap for securing said body portion to said frame means.

* * * * *